US006390294B1

(12) United States Patent
Fiore, Jr. et al.

(10) Patent No.: US 6,390,294 B1
(45) Date of Patent: May 21, 2002

(54) CASE FOR ARCHERY EQUIPMENT

(75) Inventors: Joseph F. Fiore, Jr., Lebabon, PA (US); John J. Hagemann, Plano, IL (US)

(73) Assignee: Plano Molding Company, Plano, IL (US)

( * ) Notice: Subject to any disclaimer, the term of this patent is extended or adjusted under 35 U.S.C. 154(b) by 0 days.

(21) Appl. No.: 09/694,187

(22) Filed: Oct. 23, 2000

(51) Int. Cl.[7] ..... B65D 85/00; F41B 5/22
(52) U.S. Cl. ..... 206/315.11; 124/86
(58) Field of Search ..... 206/315.11; 211/60.1; 224/916; 124/25.7, 186

(56) References Cited

U.S. PATENT DOCUMENTS

| | | | | | |
|---|---|---|---|---|---|
| 3,088,583 | A | * | 5/1963 | Holtz | 206/315.11 |
| 3,337,028 | A | * | 8/1967 | Glavan | 206/315.11 |
| 3,351,270 | A | * | 11/1967 | Hohnjec | 220/835 |
| 3,421,682 | A | * | 1/1969 | Eisenbach | 206/502 |
| D246,138 | S | | 10/1977 | Christensen et al. | |
| 5,242,050 | A | * | 9/1993 | Billings | 206/315.11 |
| D343,057 | S | | 1/1994 | Dickinson | |
| D358,254 | S | | 5/1995 | VanSkiver | |
| 5,456,379 | A | * | 10/1995 | Krupa et al. | 220/653 |
| 5,775,313 | A | * | 7/1998 | Bresette et al. | 124/86 |
| 5,803,069 | A | * | 9/1998 | Schreiber | 124/86 |

OTHER PUBLICATIONS

Doskocil Mfg. Co. 1995 Gun Guard Quality Sporting Cases Catalog, p. 13 (Archery Edition).
Woodstream (an Ekco Group Company) 1991 Hunting and Shooting Accessories Catalog, (Inside cover—Field Locker), p. 2.
Kolpin Mfg., Inc. 1997 Hunting Products Catalog, p. 15 (Gator Hard–Sided Bow Cases).

* cited by examiner

*Primary Examiner*—Bryon P. Gehman
(74) *Attorney, Agent, or Firm*—Vedder, Price, Kaufman & Kammholz

(57) ABSTRACT

A case for archery equipment includes, interengaging first and second half portions connected for movement between open and closed positions. The first half portion includes a first wall defining a first interior recess and having a first mating rim. The first half portion further includes a plurality of first supports formed in the first wall, and located within the first interior recess. The second half portion includes a second wall defining a second interior recess and having a second mating rim. The second half portion further includes a plurality of second supports formed in the second wall and located within the second interior recess. Each first support has a first longitudinal axis and is aligned along a common first axis which intersects each first longitudinal axis normally within and defining a first common plane. Each second support has a second longitudinal axis and is aligned along a common second axis which intersects each second longitudinal axis normally within defining a second and common plane. The first and second planes are parallel and offset in the open position and aligned in opposition in the closed position such that each first support engages each said second support in mating contact. A load applied to the case in a closed position is distributed among the first and second supports and the first and second mating rims, resulting in a protective zone defined by the first and second interior recesses.

88 Claims, 3 Drawing Sheets

CASE FOR ARCHERY EQUIPMENT

BACKGROUND OF THE INVENTION

The present invention relates generally to a case for archery equipment, and more particularly, to a molded, protective case which is adapted for easy, low-cost mass production manufacture and which prevents damage to the equipment stored therein, by even distribution of loads and forces thereupon.

Transporting archery equipment, such as bows and arrows, has always been a difficult undertaking. By their very nature, the equipment is large and cumbersome. The equipment is also relatively delicate in comparison to its size. In particular, modern bows have very complex structure in order to provide the sophisticated functions now expected. While a bow may be disassembled for transportation, it is considered a major disadvantage if this is necessary. Accuracy is lost if these bows are disassembled. However, the bows and arrows are also very delicate when subjected to forces different from those of ordinary operation. Slight or unseen damage to bows can result in catastrophic failure of the equipment, which could even injure the user. Arrow shafts are preferably made from very thin wall aluminum tubing or carbon fiber. The slightest tweak, curve or bend in the arrow shaft will cause the arrow to fly off course when in use, or with carbon fiber, an off-axis impact can destroy the arrow shaft. Consequently, it is advantageous to use a protective case which can prevent any damage to the implements therein from forces and loads applied thereto.

Current standard protective measures include fabric, soft-sided, padded cases, and traditional, rectangular suitcase-style cases. For many reasons, there are obvious disadvantages to the soft-sided cases. First, and foremost, is the lack of protection afforded the equipment inside. These cases are useful only in that all of the equipment may be transported in one case. As a result, they have rather limited usefulness for serious archers, or those concerned about the condition of their equipment. Accordingly, they are priced on the lower end of the scale. It should be appreciated that although the sides of the case are padded, the large side panels easily deform when subjected to external loads or forces and only protect the equipment from abrasion or minimal force impacts, such as setting the case down. Without a stiff exterior panel, the level of protection afforded is only sufficient for the infrequent or occasional user.

The traditional suitcase design for archery equipment provides more protection for the contents. Commonly, their construction includes a plastic shell having an extruded metal band affixed about the perimeter of each half of the shell, and a metal piano-style hinge joining the halves together. One disadvantage is the size of such a case. Available only in conventional rectangularly-shaped designs, there is a considerable amount of extra space that is not used which renders the case cumbersome and unweildly. Another major disadvantage is the sizable planar side panels. The shape of a bow requires a case with large side panels relative to the ends. As a result, the sides of the case easily deform inward when subjected to an external load or force. The side panels of such known cases are not designed to absorb or distribute significant impact forces. The perimeter edges are designed to carry the loads; however, the metal bands are easily damaged and as such misalignment is common. As a result, known suitcase designs permit deformation of the side panels to the extent that the bow and/or arrows can be damaged, and create haphazard load distributions.

The advent of carbon fiber arrow shafts resulted in a lighter, stiffer arrow with a much thinner shaft. Previous quiver or arrow holder designs produced over the last 40-plus years are sized for the much larger aluminum arrow shafts. As a result, they are unable to properly secure the carbon fiber arrows in position for transportation or use. Consequently, archers must purchase a quiver for each type of arrow shaft, totally convert to the new arrow shafts, or not use the new arrow shafts. Other types and kinds of arrow holders have faced similar disadvantages.

Transporting or storing bows inside either of the above prior art cases has obvious disadvantages; namely, the inability to ensure proper alignment and to protect the bow from damage by external forces. Consequently, all previous design attempts to provide an adequate protective enclosure have failed. Likewise, transporting or storing arrows inside the above-described cases has obvious disadvantages, namely, the inability to protect the arrow shafts from bending or breaking due to their weak designs. Consequently, all previous design attempts to incorporate an arrow holder with or inside a case have failed to provide adequate protection.

Therefore, there is a significant demand for a durable, protective case for safely transporting or storing archery equipment which provides the advantages of low-cost, high-strength, impact-resistance, load distribution, automatic alignment and a multi-functional use.

SUMMARY OF THE INVENTION

It is therefore a general object of the present invention to provide a protective case for the transportation and/or storage of archery equipment which is inexpensive, yet impact resistant, non-deformable, sturdy and durable.

Another object of the present invention is to provide a case which has an interior cavity dimensioned to receive an archery bow and a plurality of arrows.

Yet another object of the present invention is to provide a protective bow case which resists and distributes deforming forces impacting on the comparatively large panels.

Still another object of the present invention is to provide a protective case with reinforcing pillars which brace and prevent the comparatively large panels from significantly deforming from their original location.

Another further object of the present invention is to provide a protective bow case with integrally molded reinforcing pillars which cooperate to inhibit deformation of the comparatively large panels by effectively reducing the flexibility of the large panels and distributing any loads or forces impinging on the case.

Yet another further object of the present invention is to provide a case with an integrally molded reinforcing pillars formed in each half of the enclosure which each cooperate and interconnect when the case is in a closed position to reduce the flexibility of the large panels of the case from damaging deformation and to distribute any loads or forces impinging on the case.

Still yet another further object of the present invention is to provide a protective case for the transportation and/or storage or archery equipment which has an inexpensive, easy to manufacture, integratable, and simple-to-use arrow holder.

Another object of the present invention is to provide an arrow holder which securely mounts arrow shafts having two different diameter dimensions.

Yet another object of the present invention is to provide a first groove for removably securing two differently sized arrow shafts in an interfering manner which has second grooves formed therein to provide adequate flexure of the first groove such that the arrow shafts are not damaged when inserted into or removed from the first groove.

The present invention accomplishes these and other objects by way of its novel and unique structure, utilizing the following means to solve the aforementioned problems. In one principal aspect of the present invention, a case for archery equipment includes interengaging first and second case sections connected for movement between open and closed positions. The first case section includes a first wall defining a first interior recess and having a first mating rim. The first case section further includes a plurality of first reinforcing pillars formed in the first wall, and located within the first interior recess. The second case section includes a second wall defining a second interior recess and having a second mating rim. The second case section further includes a plurality of second reinforcing pillars formed in the second wall and located within the second interior recess. Each first reinforcing pillar has a first longitudinal axis and is aligned along a common first axis which intersects each first longitudinal axis normally within and defining a first common plane. Each second reinforcing pillar has a second longitudinal axis and is aligned along a common second axis which intersects each second longitudinal axis normally within defining a second and common plane. The first and second planes are parallel and offset in the open position and aligned in opposition in the closed position such that each first reinforcing pillar engages each said second reinforcing pillar in mating contact. A load applied to the case in a closed position is distributed among the first and second reinforcing pillars and the first and second mating rims, resulting in a protective zone defined by the first and second interior recesses.

In another principal aspect of the present invention, an arrow holder is adapted for mounting within a case for archery equipment, where the case includes interengaging first and second case sections where each case section has a respective first and second interior recess, including at least one comb number having a plurality of alternatively disposed first and second grooves formed therein. The first grooves have a first depth. The second grooves have a second depth which is greater than the first depth. Whereby, the second grooves are configured to removably mount arrow shafts having at least two different diameters.

These and other objects, features and advantages of the present invention will be clearly understood through consideration of the following detailed description.

BRIEF DESCRIPTION OF THE DRAWINGS

In the course of the following detailed description, reference will be made to the attached drawings wherein like reference numerals identify like parts and in which.

DETAILED DESCRIPTION OF THE PREFERRED EMBODIMENT

Figure 1:
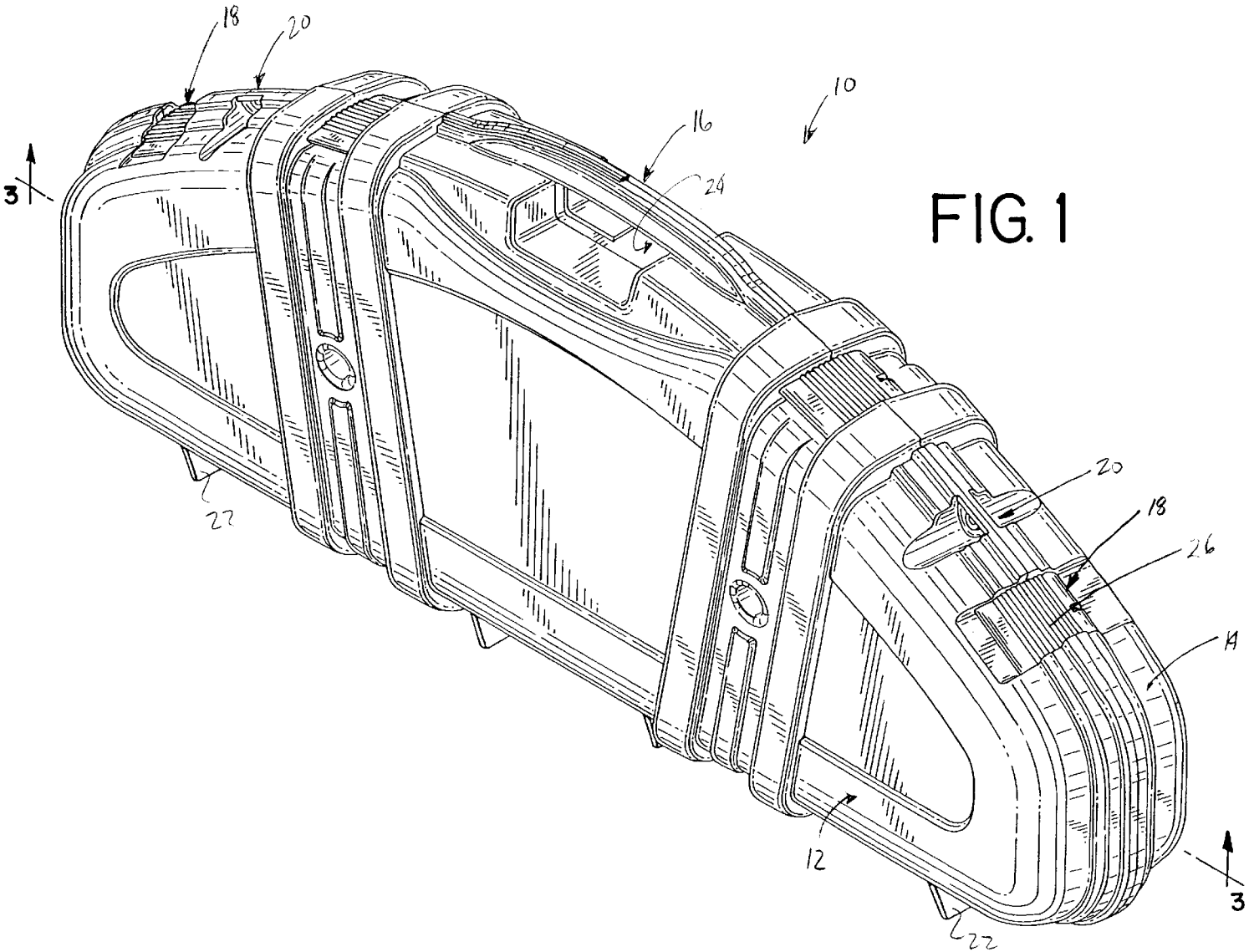
FIG. 1 is a perspective view of the case for archery equipment constructed in a closed position in accordance with the principles of the present invention.

The present invention relates to a protective case for transporting and/or storing archery implements, preferably at least a bow and a plurality of arrows. Generally, the case 10 of the present invention shown in FIGS. 1–5, includes interengaging case sections, a first case section 12 and a second case section 14 which are interconnected along a hinge line for movement between an open position, FIG. 2, and a closed position, FIGS. 1 and 3. As shown in FIG. 1, the case 10 also includes a handle 16, a plurality of latching devices 18, locking members 20, and a plurality of feet 22.

The handle 16 is formed by cooperation of the first case section 12 and the second case section 14. A passage 24 provided below the handle 16 for receiving the hand or fingers of an operator enables one to carry or move the case 10. Each latching device 18 in FIG. 2 includes an arm 26 and a catch 28. The arm 26 is movably secured to the case 10, and preferably to the second case section 14. The preferred structural components of the arm 26 are conventional, including a release lever 30 and an engagement finger 32. The catch 28 is preferably formed on the first case section 12 and comes into contact with the engagement finger 32 when the arm 26 is moved into a latching position as illustrated in FIG. 1. Pressure applied to the arm 26 forces interlocking of the engagement finger 32 with catch 28. The release lever 30 provides a mechanical advantage for an operator to overcome the interlocking forces between the engagement finger 32 and the catch 28 in order to move the case 10 to an open position. It will be recognized by those having ordinary skill in the art that any other presently available, suitable latching devices may be substituted and achieve the identical function.

The locking members 20 are basically bores 34 formed in each of the first and second case sections 12 and 14 which provide a passage through which an operator may insert a conventional locking element (not shown). Preferably, the locking element is a padlock which is opened by key or combination. The case 10 may not be opened without destroying the case 10, if the locking elements are not removed.

A plurality of feet 22 are provided in association with the first and second case sections 12 and 14 such that the case 10 may be oriented in a free-standing vertical position as shown in FIG. 1. These feet 22 assist an operator in transportation of the case by providing a stable base for maintaining the vertical orientation.

Figure 2:
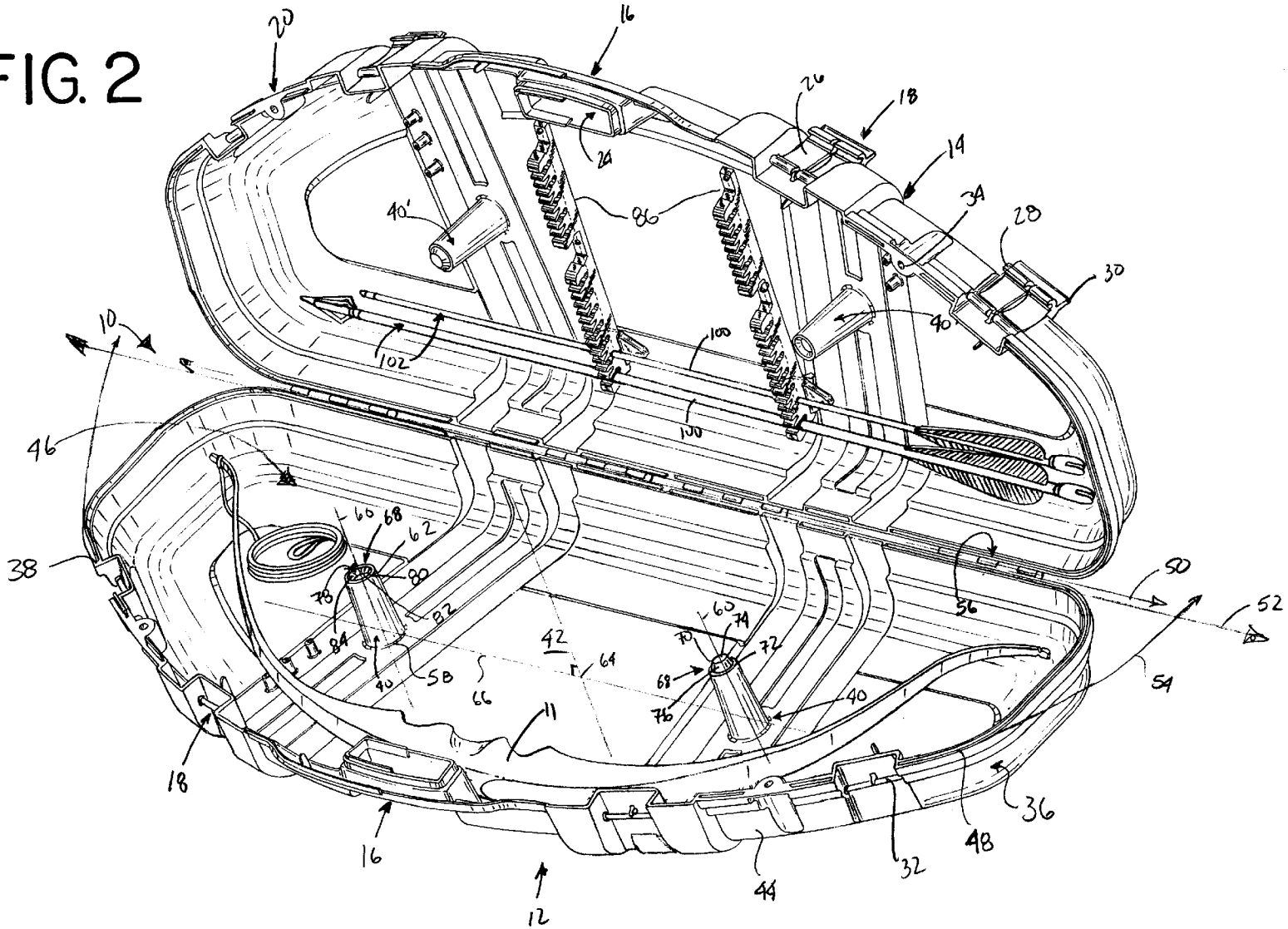
FIG. 2 is a perspective view of the protective enclosure of FIG. 1 in an open position illustrating the interior recesses thereof, and the arrow holders disposed therein.

As shown in FIG. 2, the first case section 12 generally includes a first wall 36, a first mating rim 38, a hinge line 50 and a plurality of first reinforcing pillars 40. The first wall 36 is formed generally as a shell having a generally tub-like configuration. An interior surface 42 and an exterior surface 44 cooperate to define the first wall 36 and the thickness thereof. The first wall interior surface 42 defines a first interior recess or cavity 46 which is configured and dimensioned to receive an archery bow 11 therein. The first mating rim 38 is formed as the substantially circumferentially extending edge 48 of the first wall 36. The. configuration of the first mating rim 38 generally represents the overall outline of the case 10. Preferably the configuration of the case 10 and mating rim 38 is generally described as a chord, represented by line 52, intersecting an arc, represented by line 58. It will be recognized by those of ordinary skill in the art that the shape or configuration of the case 10 is not limited to the preferred version and is offered by way of example only. The hinge line 50 is generally coincident with the chord line 52. The first hinge structures 56 are disposed at selected positions on the first mating rim 38 along the hinge line 50. The hinge structures are formed integrally with the first case section 12 and may be configured in any of a number of conventional ways. Snap-fit, projection/receptacle, living, and frangibly created hinges may be used or freely substituted as will be recognized by one of ordinary skill in the art.

Figure 3:
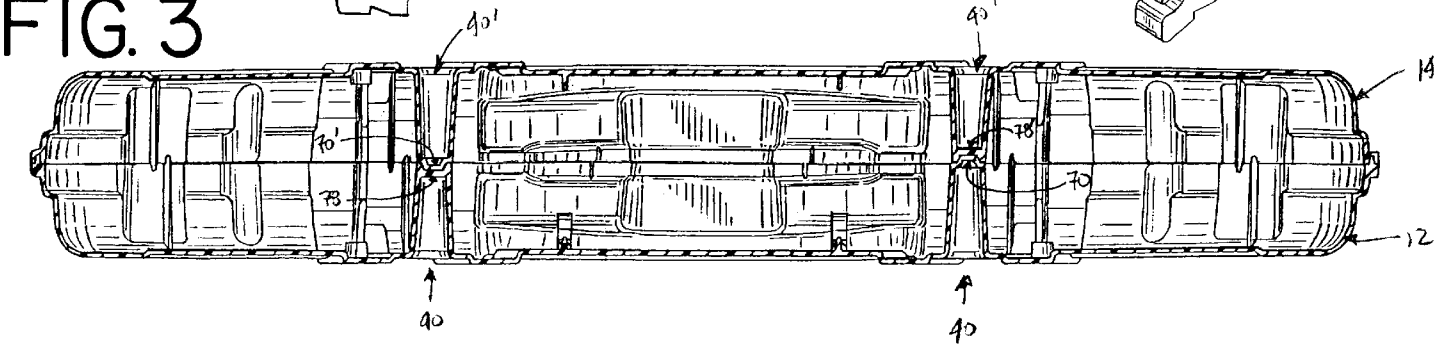
FIG. 3 is a cross-sectional view taken along lines 3—3 of FIG. 1, illustrating the case in a closed position and the reinforcing pillars interengaged.

A plurality of first reinforcing pillars 40 are shown in FIGS. 2 and 3. These reinforcing pillars 40 are formed in or integrally molded with the first case section 12. Generally, each reinforcing pillar 40 is configured as a substantially hollow, tubular projection. Specifically, each reinforcing pillar 40 is formed as a hollow truncated cone. A base 58 is disposed adjacent the interior surface 42. The reinforcing pillar 40 extends away from the interior surface 42 a certain extent generally along a longitudinal axis 60 to a free end 62 thereof. Each reinforcing pillar 40 is disposed within the first interior recess or cavity 46. The pair of reinforcing pillars 40 shown in FIGS. 2 and 3, is the preferred embodiment for the present invention, but those of ordinary skill in the art will recognize and acknowledge that more supports may be added without diverging from the purpose and intent of the subject invention. Each first reinforcing pillar 40 has a first longitudinal axis 60 which is disposed spaced along a common first axis 66 which intersects each first longitudinal axis 60 within and defining a first common plane 64. The common first axis 66 and first common plane 64 are generally parallel to and spaced apart from the hinge line 50.

The free ends 62 of the reinforcing pillars 40 alternately have an interlocking feature 68 formed therein. A projection 70 is preferably disposed on one reinforcing pillar 40 and extends away from the shoulder 72 defined at the free end 62 in a generally truncated cone configuration with a top surface 74 disposed at the furthest extent from the interior surface 42. A conical annular surface 76 connects the annular shoulder 72 with the top surface 74. A cavity 78 is preferably formed in the free end 62 of the other reinforcing pillar 40. A shoulder 80 is defined at the free end 62. A bottom surface 82 is connected to the shoulder 80 by an inverted truncated conical annular surface 84 which extends therebetween. It will be recognized by one of ordinary skill in the art that the angle of the conical annular surfaces 76 and 84 are substantially similar.

The second case section 14 is generally a mirror image of the first case section 12, with the exception of the arrow holders 86. Thus, lengthy discussion of the features of the second case section 14 will be avoided by the use of prime element numerals, such as 40' for the plurality of second reinforcing pillars, in order to discuss the second case section 14. It should be noted however, that there are several differences in structure which will be discussed below.

The structural and positional aspects of the reinforcing pillars 40' of the second case section 14 substantially mirror those reinforcing pillars 40 described in the first case section 12, with the following exception. The projection 70' and cavity 78' of the second case section 14 are respectively in alignment and opposition with the cavity 78 and projection 70 of the first case section 12 when the case 10 is in a closed position. FIG. 3. The cavity 78 and projection 70' and the projection 70 and cavity 78' cooperatively interlock thereby connecting the first and second case sections 12 and 14 such that loads applied to the case 10 are evenly distributed. Thus, the contents, namely bow and arrows, are not damaged. When the case 10 is in the closed position, the coupled reinforcing pillars 40 and 40' also prohibit lateral misalignment of the first and second case sections 12 and 14 whereby the first and second mating rims 38 and 38' are also properly aligned and in opposition.

Figure 5:
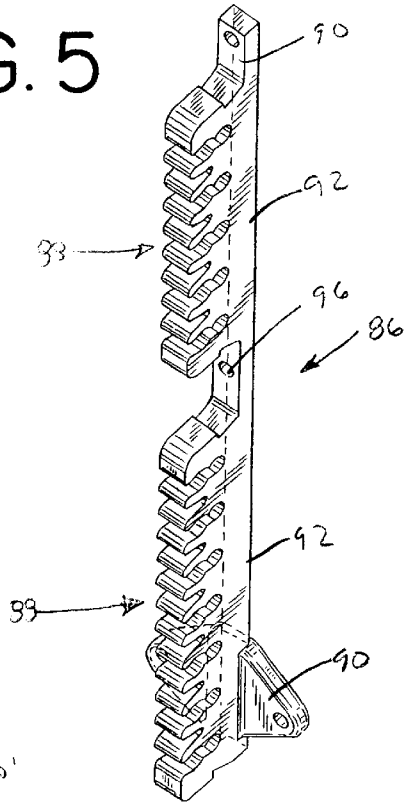
FIG. 5 is a perspective view of the arrow holder of FIG. 4.
Figure 4:
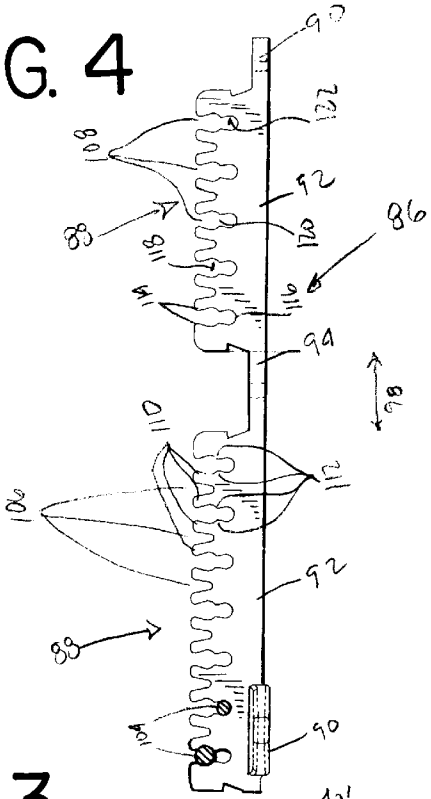
FIG. 4 is a side elevation view of the arrow holder of FIG. 2 constructed in accordance with the principles of the present invention.

A pair of arrow holders 86 are shown in FIG. 2 attached to the second case section 14. Detailed features of the holders 86 are shown in FIGS. 4 and 5. Each arrow holder 86 generally includes a comb-like member 88 and a plurality of mounting flanges 90. The comb member has a pair of base portions 92, each having a plurality of fingers or tines 110 which extend away therefrom to define a plurality of grooves. A mounting element 94 is disposed between the pair of base portions 92 generally formed as a large notch. An aperture 96 is disposed therein for receiving a mounting device to secure the arrow holder 86 to the second case section 14. The aperture 96 is substantially aligned with axis 66 and a width 98 of the notch generally corresponds with the outer diameter 100 of the base end 58' of the reinforcing pillars 40'. Accordingly, arrows 102 do not contact the reinforcing pillars 40'.

The comb member 88 removably mounts a plurality of arrows having a variety of differently sized arrow shafts 104. A plurality of alternately disposed first and second grooves 106 and 108 are defined between adjacent fingers or tines 110. The arrow shafts 104 interferingly engage the second grooves 108. The first grooves 106 have a first depth represented by the extent of arrow D1, and a first width represented by the arrow W1, which vary along the first depth D1. The extent of the first depth D1 and the extent and variance of the first width W1 in combination with the thickness and durometer of the elastomeric material used to form the comb member determines the amount of flexure of the adjacent fingers that define a first groove 106 toward one another when an arrow shaft 104 is inserted into interfering engagement in an adjacent second groove 108.

The second grooves 108 have a second depth represented by the extent of arrow D2, which is greater than the first depth D1, and a second width represented by the arrow W2, which vary along the second depth D2. The second width W2 at the top 114 of the second grooves 108 is greater than the second width W2 at the bottom 116 of the second grooves 108. An intermediate portion 112 of the second grooves 108 has second width W2 less than the second width W2 at the bottom 116 of the second grooves 108. A first chamber 118 is formed near the top 114 of the second grooves 108 generally configured to receive and interferingly engage an arrow shaft 104 having a first diameter D3. The opening to the first chamber 118 is substantially equivalent to the second width W2 at the top 114 of the second grooves 108. The intermediate portions 112 define a lower extent of the first chamber 118 and a passage 120. A second chamber 122 is disposed below the first chamber 118 and communicates therewith by the passage 120. An arrow shaft 104 having a second diameter D4 is interferingly engaged within the second chamber 122 after insertion through the first chamber 118 and the passage 120. The first chamber 118 is larger than the second chamber 122, much like the arrow shaft 104 of a first diameter D3 is larger than the arrow shaft 104 of a second diameter D4.

The mounting flanges 90 are integrally formed or molded from the same elastomeric material as the remainder of the comb member 88. Apertures 124 receive and engage mounting projections molded or formed in the second half portion 14. Thus, the comb member 88 is positively retained within the second interior recess.

In use, the case 10 in closed position is opened by pulling the release lever 30 on each latch 18 with sufficient force to overcome the interconnection force between the engagement finger 32 and the catch 28. Accordingly, each latch 18 may be disconnected. The second case section 14 may then be moved through an arc of at least 180° in order to place the case in an open position. An archery bow 11 may then be secured within the first interior recess 46 for protective storage or transportation. Arrows 102 having arrow shafts 104 of different diameters may be secured in the arrow holder 86 located in the second case section for protective storage or transportation. In order to protect the contents of the case 10 namely the bow and arrows, the case 10 must be moved into a closed position. The second case section 14 may then be moved about the hinge line 50 until mating contact is made between the reinforcing pillars 40 and 40', and the mating rims 38 and 38'. The projections 70 and 70' interlock with the corresponding cavities 78' and 78, respectively, in order to automatically align the mating rims 38 and 38'. The latches 18 may then be engaged to secure the first and second case sections 12 and 14 together. Any load or force imparted to the case 10 is then distributed evenly among the reinforcing pillars 40 and 40' and the mating rims 38 and 38'. Advantageously, the mating rims 38 and 38' are prevented from misalignment during an impact or load by the interlocked reinforcing pillars 40 and 40'.

Thus, it will be apparent that the bow case 10 includes a first half 12 and a second half 14 formed as first and second case sections connected in clamshell fashion such that the first and second case sections 12 and 14 are moveable between an open position shown in FIG. 2 and a closed position shown in FIGS. 1 and 3. It will be further apparent that the first and second case sections 12 and 14 each respectively define interior cavities 78 and 78' which jointly define an interior storage compartment when the case 10 is closed. Still further, it will be apparent that each of the first and second case sections 12, 14 has a plurality of reinforcing pillars 40 and 40' defined as sets of reinforcing pillars affixed to respective first and second case sections to project into the storage compartment when the first and second case sections 12 and 14 are closed. The reinforcing pillars 40 and 40' have free ends 62, 62'. It will be apparent that each set of reinforcing pillars 40, 40' includes at least one reinforcing pillar configured as a female reinforcing pillar and at least one configured as a male reinforcing pillar, each male pillar being aligned and in registry with a female pillar when the case sections 12 and 14 are closed, that the free end 62, 62' of each female reinforcing pillar has a cavity 78 defining a recessed portion, and the free end 62, 62' of each male reinforcing pillar has a projection 70 defining a projection portion configured to be snugly received within the recessed portion when the case sections 12 and 14 are closed.

While the preferred embodiments of the invention have been shown and described, it will be apparent to those skilled in the art that changes and modifications may be made therein without departing from the spirit of the invention, the scope of which is defined by the appended claims.

We claim:

1. A case for storage and transport of archery equipment, comprising:

interengaging first and second case sections connected for movement between open and closed positions;

said first case section including a first wall defining a first interior recess and having a first mating rim;

said first case section further including a set of first reinforcing pillars formed in said first wall, disposed within said first interior recess wherein the set of first pillars includes at least one male pillar and at least one female pillar;

said second case section including a second wall defining a second interior recess and having a second mating rim;

said second case section further including a set of second reinforcing pillars formed in said second wall, disposed within said second interior recess wherein the set of second pillars includes at least one male pillar and at least one female pillar;

each said first pillar having a first longitudinal axis and being aligned along a common first axis which intersects each first longitudinal axis within and defining a first common plane;

each said second pillar having a second longitudinal axis and being aligned along a common second axis which intersects each second longitudinal axis within and defining a common second plane, where said first and second planes are parallel and offset in said open position, and aligned in opposition in said closed position such that each said first pillar engages one of said second pillar in mating contact;

whereby a load force to said case when said case is in said closed position is distributed among said first and second pillars and said first and second mating rims resulting in a protective zone defined by said first and second interior recesses.

2. The case as recited in claim 1, wherein said set of first pillars are integrally molded in said first case section, and said set of second pillars are integrally molded in said second case section.

3. The case as recited in claim 1, wherein said first and second half portions are hingedly connected for movement about a hinge line between said open and closed positions.

4. The case as recited in claim 3, wherein said common first axis is generally parallel to and spaced apart from said hinge line, and said common second axis is generally parallel to and spaced apart from said hinge line.

5. The case as recited in claim 1, wherein each of said interengaged first and second pillars are in alignment and opposition along a common longitudinal axis defined by said first longitudinal axis and said second longitudinal axis when said case is in said closed position.

6. The case as recited in claim 1, wherein each of said first and second pillars are coupled when said case is in said closed position prohibit lateral misalignment of said first and second case sections.

7. The case as recited in claim 1, wherein said male pillars include a projection formed on a free end thereof.

8. The case as recited in claim 7, wherein said female pillars include a recess formed in a free end thereof for receiving and engaging one of said male pillar projections when said case is in said closed position such that said male and female pillars are interlocked with one another.

9. The case as recited in claim 1, wherein said protective zone is configured to receive an archery bow therein.

10. The case as recited in claim 1, wherein said case further includes at least one comb member secured to said second half portion interior recess for removably mounting a plurality of arrows thereto.

11. The case as recited in claim 10, wherein said at least one comb member further includes a plurality of alternately disposed first and second grooves formed therein.

12. The case as recited in claim 11, wherein said first grooves have a first depth.

13. The case as recited in claim 12, wherein said second grooves have a second depth which is greater than said first depth.

14. The case as recited in claim 13, wherein said second grooves have a second width which vary along said second depth.

15. The case as recited in claim 14, wherein said second width at a top of said second grooves is greater than said second width at a bottom of said second grooves.

16. The case as recited in claim 15, wherein said second grooves each include an intermediate portion having a width which defines a first chamber on top of a second chamber and a passageway for communication between said first and second chambers.

17. The case as recited in claim 16, wherein said first chamber is larger than said second chamber, such that said first chamber removably mounts arrows having a first shaft diameter and said second chamber removably mounts arrows having a second shaft diameter.

18. The case as recited in claim 12, wherein said first grooves have a first width which decreases along said first depth.

19. In a bow case having first and second case sections connected in clamshell fashion to move between open and closed positions, said case sections jointly defining an interior compartment when closed, each of said case sections having a set of reinforcing pillars affixed thereto to project into said compartment when said sections are closed, said pillars each having a free end, each of the free ends of individual ones of said pillars of said first of said case sections being aligned with and abutting one of the free ends of individual ones of said pillars of said second of said case sections when said case sections are closed, the improvement wherein each said set of pillars includes at least one female pillar and at least one male pillar, and wherein each male pillar is aligned and in registry with a female pillar when said case sections are closed, the free end of each said female pillar having a portion recessed from the free end, the free end of each said male pillar having a projecting portion extending from the free end configured to be snugly received within said recessed portion when said case sections are closed.

20. The bow case as recited in claim 19, wherein said pillars are integrally molded in said first and second case sections.

21. The bow case as recited in claim 19, wherein said first and second case sections are hingedly connected for movement about a hinge line between said open and closed positions.

22. The bow case as recited in claim 19, wherein each of said male and female pillars are coupled when said bow case is in said closed position prohibiting lateral misalignment of said first and second case sections.

23. The bow case as recited in claim 19, wherein said bow case further includes at least one comb member secured to one of said case sections for removably mounting a plurality of arrows thereto.

24. The bow case as recited in claim 23, wherein said at least one comb member further includes a plurality of alternately disposed first and second grooves formed therein.

25. The bow case as recited in claim 24, wherein said first grooves have a first depth.

26. The bow case as recited in claim 25, wherein said second grooves have a second depth which is greater than said first depth.

27. The bow case as recited in claim 26, wherein said second grooves have a second width which vary along said second depth.

28. The bow case as recited in claim 27, wherein said second width at a top of said second grooves is greater than said second width at a bottom of said second grooves.

29. The bow case as recited in claim 28, wherein said second grooves include an intermediate portion having a width, which defines a first chamber on top of a second chamber and a passageway for communication between said first and second chambers.

30. The bow case as recited in claim 29, wherein said first chamber is larger than said second chamber, such that said first chamber removably mounts arrows having a first shaft diameter and said second chamber removably mounts arrows having a second shaft diameter.

31. The bow case as recited in claim 25, wherein said first grooves have a first width which decreases along said first depth.

32. A case for storage and transport of archery equipment, comprising:

interengaging first and second case sections connected for movement between open and closed positions;

said first case section including a first wall defining a first interior recess and having a first mating rim;

said first case section further including a plurality of first reinforcing pillars formed in said first wall, disposed within said first interior recess;

said second case section including a second wall defining a second interior recess and having a second mating rim;

said second case section further including a plurality of second reinforcing pillars formed in said second wall, disposed within said second interior recess;

each said first reinforcing pillar having a first longitudinal axis and being aligned along a common first axis which intersects each first longitudinal axis thereby defining a first common plane;

each said second reinforcing pillar having a second longitudinal axis and being aligned along a common second axis thereby each second longitudinal axis thereby defining a common second plane, where said first and second planes are parallel and offset in said open position, and aligned in opposition in said closed position such that each said first reinforcing pillar engages one of said second reinforcing pillars in mating contact; and at least one comb member secured to one of said case sections for removably mounting a plurality of arrows thereto, said at least one comb member including a plurality of alternately disposed first and second grooves formed therein, said first grooves having a first depth, said second grooves having a second depth which is greater than said first depth, said second grooves each include an intermediate portion having a width which defines a first chamber on top of a second chamber and a passageway for communication between the first and second chambers;

whereby a load force to said case when said case is in said closed position is distributed among said first and second reinforcing pillars and said first and second mating rims resulting in a protective zone defined by said first and second interior recesses.

33. The case as recited in claim 32, wherein said first reinforcing pillars are integrally molded in said first case section, and said second reinforcing pillars are integrally molded in said second case section.

34. The case as recited in claim 32, wherein said first and second case sections are hingedly connected for movement about a hinge line between said open and closed positions.

35. The case as recited in claim 39, wherein said common first axis is generally parallel to and spaced apart from said hinge line, and said common second axis is generally parallel to and spaced apart from said hinge line.

36. The case as recited in claim 32, wherein each of said interengaged first and second reinforcing pillars are in alignment and opposition with each other along a common longitudinal axis defined by said first longitudinal axis and said second longitudinal axis when said case is in said closed position.

37. The case as recited in claim 32, wherein each said first and second reinforcing pillars are coupled when said case is in said closed position prohibiting lateral misalignment of said first and second case sections.

38. The case as recited in claim 32, wherein at least one of said first reinforcing pillars further includes a projection formed on a free end thereof.

39. The case as recited in claim 38, wherein at least one of said second reinforcing pillars further includes a cavity formed in a free end thereof for receiving and engaging said at least one first support projection when said case is in said closed position such that said first and second reinforcing pillars are interlocked with one another, thereby connecting said first and second case sections such that forces applied to said case are evenly distributed.

40. The case as recited in claim 39, wherein half of said first reinforcing pillars include a projection formed on a free end thereof, and half of said first reinforcing pillars include a cavity formed in a free end thereof.

41. The case as recited in claim 32, wherein said protective zone is configured to receive an archery bow therein.

42. The case as recited in claim 32, wherein said first chamber is larger than said second chamber, such that said first chamber removably mounts arrows having a first shaft diameter and said second chamber removably mounts arrows having a second shaft diameter.

43. An arrow holder adapted for mounting within a case for archery equipment, the case including interengaging first and second case sections where each said case section has a respective first and second interior recess, comprising:

at least one comb member having a plurality of alternately disposed first and second grooves formed therein;

said first grooves having a first depth;

said second grooves having a second depth which is greater than said first depth;

said second grooves each including an intermediate portion which defines a first chamber on top of a second chamber and a passageway for communication between the first and second chamber, whereby said second grooves are configured to removably mount arrow shafts having at least two different diameters.

44. The arrow holder as recited in claim 43, wherein said first chamber is larger than said second chamber, such that said first chamber removably mounts arrows having a first shaft diameter and said second chamber removably mounts arrows having a second shaft diameter.

45. The arrow holder as recited in claim 43, wherein said first grooves each have a first width which decreases along said first depth.

46. In a bow case having first and second, case sections connected in clamshell fashion to move between open and closed positions, said case sections jointly defining an interior compartment when closed, each of said case sections having a set of reinforcing pillars affixed thereto to project into said compartment when said case sections are closed, said pillars each having a free end, each of the free ends of individual ones of said pillars of said first of said case sections being aligned with and abutting one of the free ends of individual ones of said pillars of said second of said case sections when said case sections are closed, the improvement wherein each said set of pillars includes at least one female pillar and at least one male pillar, wherein each male pillar is aligned and in registry with one female pillar when said case sections are closed, the free end of each said female pillar having a recessed portion, the free end of each said male pillar having a projecting portion configured to be snugly received within said recessed portion when said case sections are closed, wherein said bow case further includes at least one comb member secured to one of said case sections for removably mounting a plurality of arrows thereto, said at least one comb member further including a plurality of alternately disposed first and second grooves formed therein, said first grooves have a first depth, said second grooves have a second depth which is greater than said first depth, said second grooves each include an intermediate portion which defines a first chamber on top of a second chamber and a passageway for communication between the first and second chamber.

47. The bow case as recited in claim 46, wherein said pillars are integrally molded in said first and second case sections.

48. The bow case as recited in claim 46, wherein said first and second case sections are hingedly connected for movement about a hinge line between said open and closed positions.

49. The bow case as recited in claim 46, wherein each of said male and female pillars are coupled when said bow case is in said closed position prohibiting lateral misalignment of said first and second case sections.

50. The bow case as recited in claim 46, wherein said first chamber is larger than said second chamber, such that said first chamber removably mounts arrows having a first shaft diameter and said second chamber removably mounts arrows having a second shaft diameter.

51. The bow case as recited in claim 46, wherein said first grooves each have a first width which decreases along said first depth.

52. In a bow case having first and second case sections connected clamshell fashion to move between open and closed positions, said case sections jointly defining an interior compartment when closed, each of said case sections having a set of reinforcing pillars affixed thereto to project into said compartment when said case sections are closed, said pillars each having a free end, each of the free ends of individual ones of said pillars of said first of said case sections being aligned with and abutting one of the free ends of individual ones of said pillars of said second of said case sections when said case sections are closed, the improvement wherein each said set of pillars includes at least one female pillar and at least one male pillar, and wherein each male pillar is aligned and in registry with one of the female pillars when said case sections are closed, the free end of each said female pillar having a portion recessed from the free end, and the free end of each said male pillar having a projecting portion, extending from the free end thereby defining a shoulder for engaging contact with the free end of the female pillar, whereby said projecting portion is configured to be received within said recessed portion when said case sections are closed to prevent lateral displacement of said female pillar free end and said male pillar shoulder.

53. The bow case as recited in claim 52, wherein said pillars are integrally molded in said first and second case sections.

54. The bow case as recited in claim 52, wherein said first and second case sections are hingedly connected for movement about a hinge line between said open and closed portions.

55. The bow case are recited in claim 52, wherein said bow case further includes at least one comb member secured to said second case section for removably mounting a plurality of arrows thereto.

56. The bow case as recited in claim 55, wherein said at least one comb member further includes a plurality of alternately disposed first and second grooves formed therein.

57. The bow case as recited in claim 56, wherein said first grooves have a first depth.

58. The bow case as recited in claim 57, wherein said second grooves have a second depth which is greater than said first depth.

59. The bow case as recited in claim 58, wherein said second grooves each have a second width which varies along said second depth.

60. The bow case as recited in claim 59, wherein said second grooves include an intermediate portion having a width which defines a first chamber on top of a second chamber and a passageway for communication between said first and second chambers.

61. The bow case as recited in claim 60, wherein said first chamber is larger than said second chamber, such that said first chamber removably mounts arrows having a first shaft diameter and said second chamber removably mounts arrows having a second shaft diameter.

62. The bow case as recited in claim 57, wherein said first grooves have a first width which decreases along said first depth.

63. An arrow holder comprising:

a comb member having a plurality of alternatively disposed first and second grooves formed therein;

said first grooves having a first depth; and said second grooves having a second depth which is greater than said first depth;

said second grooves including an intermediate portion having a width which defines a first chamber on top of a second chamber and a passageway for communication between said first and second chambers;

whereby said second grooves are configured to removably mount arrow shafts having at least two different diameters.

64. The arrow holder as recited in claim 63, wherein said second grooves have a second width which varies along said second depth.

65. The arrow holder as recited in claim 63, wherein said first chamber is larger than said second chamber, such that said first chamber removably mounts arrows having a first shaft diameter and said second chamber removably mounts arrows having a second shaft diameter.

66. The arrow holder as recited in claim 63, wherein said first grooves have a first width which decreases along said first depth.

67. In a bow case having first and second case sections connected in clamshell fashion to move between open and closed positions, said case sections jointly defining an interior compartment when closed, each of said case sections having a set of reinforcing pillars affixed thereto to project into said compartment when said case sections are closed, said pillars each having a free end, each of the free ends of individual ones of said pillars of said first of said case sections being aligned with and in registry with one of the free ends of individual ones of said pillars of said second of said case sections when said case sections are closed, the improvement wherein at least one comb member is secured to one of said case sections for removably mounting a plurality of arrows thereto, said at least one comb member including a plurality of alternately disposed first and second grooves formed therein, said first grooves have a first depth, said second grooves/save a second depth which is greater than said first depth, said second grooves each include an intermediate portion which defines a first chamber on top of a second chamber and a passageway for communication between the first and second chambers.

68. The bow case as recited in claim 67, herein said pillars are integrally molded in said first and second case sections.

69. The bow case as recited in claim 67, wherein said first and second case sections are hingedly connected for movement about a hinge line between said open and closed positions.

70. The bow case as recited in claim 67, wherein said first chamber is larger than said second chamber, such that said first chamber removably mounts arrows having a first shaft diameter and said second chamber removably mounts arrows having a second shaft diameter.

71. The bow case as recited in claim 67, wherein said first grooves each have a first width which decreases along said first depth.

72. In a bow case having first and second cape sections connected to move between open and closed positions, the improvement wherein at least one comb member is secured to one of said case sections for removably mounting a plurality of arrows thereto, said at least one comb member including a plurality of alternately disposed first and second grooves formed therein, said first grooves have a first depth, said second grooves have a second depth which is greater than said first depth, said second grooves each include an intermediate portion which defines a first chamber, on top of a second chamber and a passageway for communication between the first and second chambers.

73. The bow case as recited in claim 72, wherein said first and second case sections are hingedly connected for movement about a hinge line between said open and closed portions.

74. The bow case as recited in claim 72, wherein said first chamber is larger than said second chamber, such that said first chamber removably mounts arrows having a first shaft diameter and said second chamber removably mounts arrows having a second shaft diameter.

75. The bow case as recited in claim 72, wherein said first grooves have a first width which decreases along said first depth.

76. In a bow case having first and second case sections including first and second mating rims connected in clamshell fashion to move between open and closed positions, said case sections jointly defining an interior compartment when closed, each of said case sections having a set of reinforcing pillars affixed thereto to project into said compartment when said case sections are closed, said pillars each having a free end, each of the free ends of individual ones of said pillars of said first of said half portions being aligned with and abutting one of the free ends of individual ones of said pillars of said second of said case sections when said case sections are closed, the improvement wherein each pillar projects into the compartment a distance at least equal to the level of the respective mating rim, and each said set of pillars includes at least one female pillar and at least one male pillar, and wherein each male pillar is aligned and in registry with a female pillar when said sections are closed, the free end of each said female pillar having a portion recessed from the free end, the free end of each said male pillar having a projecting portion extending from the free end configured to be snugly received within said recessed portion when said sections are closed.

77. The bow case as recited in claim 76, wherein said pillars are integrally molded in said first and second case sections.

78. The bow case as recited in claim 76, wherein said first and second case sections are hingedly connected for movement about a hinge line between said open and closed positions.

79. The bow case as recited in claim 76, wherein each of said male and female pillars are coupled when said bow case is in said closed position prohibiting lateral misalignment of said first and second case sections.

80. The bow case as recited in claim 76, wherein said bow case further includes at least one comb member secured to one of said case sections for removably mounting a plurality of arrows thereto.

81. The bow case as recited in claim 80, wherein said at least one comb member further includes a plurality of alternately disposed first and second grooves formed therein.

82. The bow case as recited in claim 81, wherein said first grooves have a first depth.

83. The bow case as recited in claim 82, wherein said second grooves have a second depth which is greater than said first depth.

84. The bow case as recited in claim 83, wherein said second grooves have a second width which vary along said second depth.

85. The bow case as recited in claim 84, wherein said second width at a top of said second grooves is greater than said second width at a bottom of said second grooves.

86. The bow case as recited in claim 85, wherein said second grooves include an intermediate portion having a width, which defines a first chamber on top of a second chamber and a passageway for communication between said first and second chambers.

87. The bow case as recited in claim 86, wherein said first chamber is larger than said second chamber, such that said first chamber removably mounts arrows having a first shaft diameter and said second chamber removably mounts arrows having a second shaft diameter.

88. The bow case as recited in claim 86, wherein said first grooves have a first width which decreases along said first depth.

* * * * *

UNITED STATES PATENT AND TRADEMARK OFFICE

CERTIFICATE OF CORRECTION

PATENT NO. : 6,390,294 B1 
DATED : May 21, 2002
INVENTOR(S) : Joseph F. Fiore, Jr. and John J. Hagemann It is certified that error appears in the above-identified patent and that said Letters Patent is hereby corrected as shown below:

Column 6,
Line 7, after "member", insert -- 88 --

Column 14,
Line 3, after "grooves", delete "/save" and in place thereof, insert -- have --
Line 8, after "67," delete "herein" and in place thereof, insert -- wherein --
Line 22, after "second", delete "cape" and in place thereof, insert -- case --
Line 31, after "chamber" delete ","

Signed and Sealed this

Seventeenth Day of December, 2002

JAMES E. ROGAN
*Director of the United States Patent and Trademark Office*